US006871574B2

(12) United States Patent
Barber

(10) Patent No.: US 6,871,574 B2
(45) **Date of Patent: *Mar. 29, 2005**

(54) HYDRAULIC CONTROL VALVE ASSEMBLY HAVING DUAL DIRECTIONAL SPOOL VALVES WITH PILOT OPERATED CHECK VALVES

(75) Inventor: Dennis R. Barber, Oconomowoc, WI (US)

(73) Assignee: HUSCO International, Inc., Waukesha, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/447,051

(22) Filed: May 28, 2003

(65) Prior Publication Data

US 2004/0237768 A1 Dec. 2, 2004

(51) Int. Cl.[7] ..... F15B 13/01
(52) U.S. Cl. ..... 91/420
(58) Field of Search ..... 91/420, 445

(56) References Cited

U.S. PATENT DOCUMENTS

| | | | | |
|---|---|---|---|---|
| RE23,682 E | | 7/1953 | Stevenson | |
| 3,906,991 A | * | 9/1975 | Haussler | 91/420 |
| 3,933,167 A | | 1/1976 | Byers, Jr. | |
| 4,012,031 A | | 3/1977 | Mitchell et al. | |
| 4,310,062 A | | 1/1982 | Link et al. | |
| 5,018,935 A | | 5/1991 | Gage | |
| 5,349,818 A | | 9/1994 | McFadyen et al. | |
| 5,520,091 A | * | 5/1996 | Chromik | 91/420 |
| 5,542,336 A | | 8/1996 | Larkin | |
| 5,832,808 A | | 11/1998 | Ishizaki et al. | |
| 6,173,639 B1 | | 1/2001 | A'Hearn et al. | |
| 6,176,261 B1 | * | 1/2001 | Heusser | 91/420 |
| 6,499,505 B2 | | 12/2002 | Zenker et al. | |
| 6,516,706 B2 | | 2/2003 | Porter et al. | |

* cited by examiner

*Primary Examiner*—F. Daniel Lopez
(74) *Attorney, Agent, or Firm*—George E. Haas; Quarles & Brady LLP

(57) ABSTRACT

A first control valve selectively connects a first port of a double acting actuator to either a pump supply line or a tank return line, and a second control valve selectively connects a second port of the actuator to either a pump supply line or a tank return line. A first pilot operated check valve restricts fluid flow to a direction only from the first control valve to the first workport unless a pilot pressure from the second port is sufficient to open the valve for the opposite flow direction. A second pilot operated check valve restricts fluid flow to a direction only from the first control valve to the second workport unless a pilot pressure from the first port is sufficient to open the valve for the opposite flow direction. A load sense circuit is incorporated to produce signal indicating the greater pressure at the actuator ports.

17 Claims, 1 Drawing Sheet

HYDRAULIC CONTROL VALVE ASSEMBLY HAVING DUAL DIRECTIONAL SPOOL VALVES WITH PILOT OPERATED CHECK VALVES

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to hydraulic systems, and more particularly to valve assemblies for controlling the flow of hydraulic fluid to and from an actuator to produce bidirectional motion.

2. Description of the Related Art

Various types of mobile equipment are operated by a hydraulic system that drives an actuator, such as a hydraulic cylinder and piston arrangement, which receives pressurized fluid controlled by a hydraulic valve. A typical four-position control valve selectively applies the pressurized fluid to one of two cylinder chambers and drains the hydraulic fluid from the other chamber, thereby driving the actuator in one of two directions depending upon which chamber receives the pressurized fluid. Usually a proportional control valve is employed, which can be opened to varying degrees to control the rate of fluid flow to and from the associated actuator, thereby moving the element of the machine that is connected to the actuator at different speeds.

Mobile equipment often incorporate auxiliary hydraulic valves for optional or lower usage type functions. A relatively low flow control valve usually acceptable for these auxiliary functions. If electrohydraulic operation is required, simple on/off valve can be used. For example, direct acting solenoids often are utilized to shift conventional spools in a manner similar to that employed in manual valves. On/off cartridge valves also may be utilized for this purpose, but in applications that require a three-position, four-way valve arrangement, cartridge valves become relatively large and complex, so as to not be cost effective.

Conventional three-position spool valves, that are commonly used to control auxiliary functions, have a center or neutral position which blocks the flow of fluid from the pump, as well as blocking the connection of the workports to tank. In hydraulic circuits that provide load sensing to control the supply pressure from the pump, these spool valves also require a bleed connection in the neutral position to relieve the load sense pressure signal. For bidirectional operation, a load sense signal must be provided, regardless of the direction of the valve motion. This is often accomplished with a bridge type connection through which the workport pressure flows in both directions of valve operation.

Thus, it is desirable to duplicate the function of a three-position, four-way control valve with solenoid operated valves in an assembly which is as cost effective as possible.

SUMMARY OF THE INVENTION

A control valve assembly is provided for a hydraulic system having a pump supply line, a tank return line, and a double acting actuator. The control valve assembly has a first workport and a second workport for connection to the double acting actuator. A first control valve is connected to the pump supply line and the tank return line, one of which at a time is connected by different operating positions of the first control valve to a first common port. A second control valve also is connected to the pump supply line and the tank return line, one of which at a time is connected to a second common port in different operating positions of the second control valve.

A first pilot operated check valve is connected between the first common port and the first workport and has a free flow direction from the first common port to the first workport. The first pilot operated check valve has a pilot inlet connected to the second common port, wherein sufficient pressure at the pilot inlet opens the first pilot operated check valve to fluid flow from the first workport to the first common port. A second pilot operated check valve has another pilot inlet connected to the first common port, wherein sufficient pressure at the pilot inlet opens the second pilot operated check valve to fluid flow from the second workport to the second common port.

To drive the actuator in one direction, the first control valve is placed in the position in which the pump supply line is connected to the first common port and the second control valve is placed in the position in which the tank return line is connected to the second common port. The pressure at the first common port opens the first pilot operated check in the free flow direction so that fluid is supplied to the actuator via the first workport. The pressure at the first common port also is applied to the pilot inlet of the second pilot operated check valve and causes that check valve to open allowing fluid to drain to tank from the actuator via the second workport.

To drive the actuator in the opposite direction, the positions of the first and second control valves are reversed to apply fluid from the supply line to the second workport and drain fluid from the second workport to tank. Pressure at the second common port of the second control valve, when applied to the first pilot operated check valve opens that valve.

A load sense circuit preferably is provided to receive the pressures at the first and second common ports and produce a load sense signal corresponding to the greater of those pressures.

DETAILED DESCRIPTION OF THE INVENTION

Figure 1:
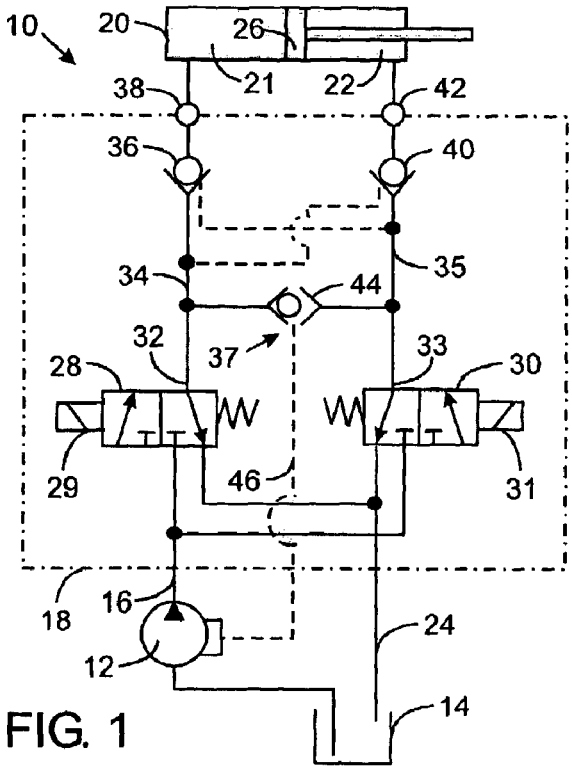
FIG. 1 is a schematic diagram of a hydraulic system utilizing the present invention.

With initial reference to FIG. 1, a hydraulic system 10 comprises a pump 12 which draws hydraulic fluid from a tank 14 and furnishes the fluid under pressure into a supply line 16. The supply line 16 is connected by a valve assembly 18 to a bidirectional hydraulic actuator, such as a hydraulic cylinder 20. The hydraulic cylinder 20 has first and second chambers 21 and 22 separated by a movable piston 26. The valve assembly 18 selectively applies hydraulic fluid under pressure from the pump 12 to one of the chambers 21 or 22 and drains hydraulic fluid from the other chamber 22 or 21 to the tank 14 via a return line 24. Whichever cylinder chamber 21 or 22 receives the pressurized fluid determines the direction that the piston 26 is driven.

The valve assembly 18 has a pair of two-position, three-way control valves 28 and 30 which have a spool that is operated by a solenoid 29 and 31, respectively. Each control valve 28 and 30 selectively connects either the supply line 16 or the tank return line 24 to a common port 32 or 33 of the valve. When energized, the first solenoid 29 drives the first control valve 28 into a first position in which the supply line 16 is connected to the first common port 32 which is coupled to a first intermediate passage 34. When the first solenoid 29 is de-energized, a spring biased the first control valve into a second position in which the first intermediate passage 34 is connected to the tank return line 24. Similarly, the second control valve 30 has a first position in which the pump supply line 16 is connected via the second common port 33 to a second intermediate passage 35 of the valve assembly 18. A spring biases the second control valve 30 into a second position where the tank return line 24 is connected to the second common port 33.

The first intermediate passage 34 is coupled by a first pilot operated check valve 36 to a first workport 38 of the valve assembly 18, which workport is connected to the first chamber 21 of the cylinder 20. The first pilot operated check valve is oriented to have a free-flow direction from the first intermediate passage 34 to the first workport 38. The flow in the opposite direction is normally blocked by the first pilot-operated check valve 36, unless the valve receives a pilot signal from the second intermediate passage 35 which is sufficient to unseat the check valve, as will be described. A second pilot operated check valve 40 is connected between the second intermediate passage 35 and a second workport 42 of the valve assembly 18, which in turn, is connected to the second chamber 22 of cylinder 20. The free flow direction of the second pilot operated check valve 40 is oriented to permit flow from the second intermediate passage 35 to the second workport 42. The second pilot operated check valve 40 blocks flow in the opposite direction unless it receives a sufficient pilot signal from the first intermediate passage 34.

The two intermediate passages 34 and 35 also are connected by a load sense circuit 37 and specifically are coupled by a shuttle valve 44 to a load sense passage 46. A load sense signal, corresponding to the greater of the two pressures at those intermediate passages, is produced in the load sense passage 46 and is used to control the output pressure of the pump 12. The exemplary hydraulic system 10 uses a variable displacement hydraulic pump 12 with the load sense passage 46 connected to the control input of the pump. Alternatively, a fixed displacement pump could be employed along with a conventional unloader valve controlled by the load sense signal.

Figure 2:
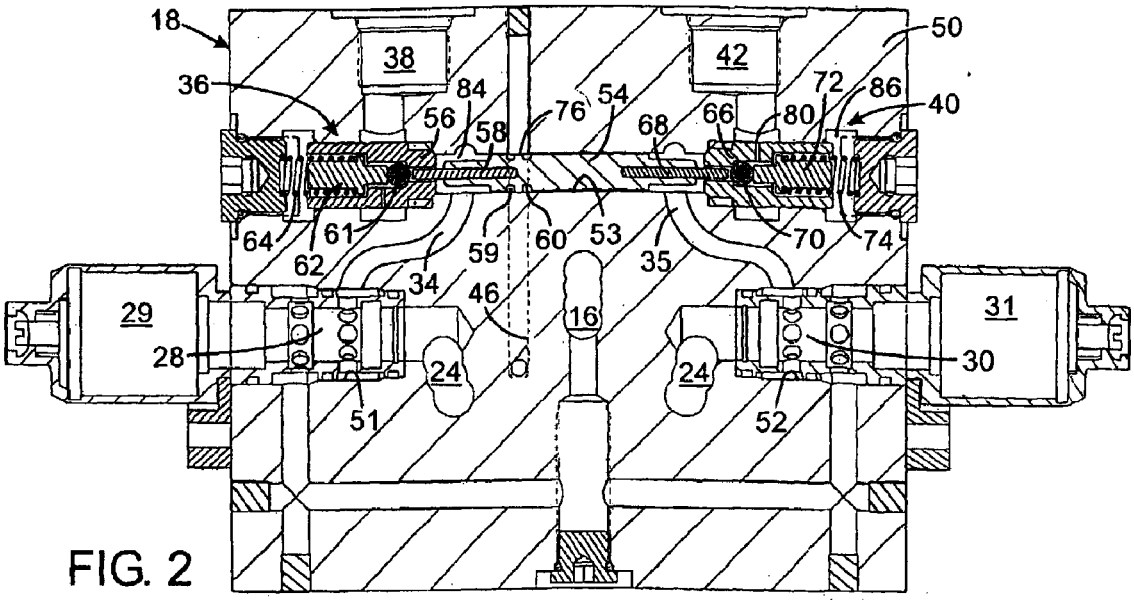
FIG. 2 is a cross-sectional view through a valve assembly that implements the hydraulic system in FIG. 1.

FIG. 2 illustrates a preferred embodiment of the physical structure for the valve assembly 18 and its components. Each of the first and second control valves 28 and 30 is located in a separate aperture 51 or 53 within the body 50 of the valve assembly. The supply line 16 and tank return 24 communicate with each of those apertures 51 and 52, as do the first and second intermediate passages 34 and 35. The solenoid operators 29 and 31 selectively position a spool of each control valve 28 and 30 to connect the first and second intermediate passages 34 and 35 to either the pump supply line 16 or the tank return line 24.

The first and second intermediate passages 34 and 35 open into a check valve bore 53 into which the workports 36 and 40 also open. A pilot plunger 54, which also forms the shuttle valve 44, is slidably received a central portion of the check valve bore 53 and has longitudinal grooves in its surface extending from each end to one of two annular notches 59 and 60, thereby allowing fluid to flow from either intermediate passage 34 or 35 into one of those notches. A central land 76 on the pilot plunger 54 between the two annular notches 59 and 60 tightly engages the inner surface of the check valve bore 53 when the pilot plunger is displaced left or right from the neutral position illustrated in FIG. 2. In the neutral position both of the annular notches 59 and 60 open into the load sense passage 46 in the valve assembly body 50.

The pilot plunger 54 engages both of the pilot operated check valves 36 and 40 located in opposite ends of the check valve bore 53. The first pilot operated check valve 36 with a first poppet 56 that abuts a first seat formed in the check valve bore 53. The first poppet 56 has a central aperture there through into which a pin 58 of the pilot plunger 54 extends. A first sphere 61 is received within the poppet aperture and is urged against a second seat within that aperture by a piston 62 which is biased by a spring 64 to place the first check 36 valve in the closed position. The second pilot operated check valve 40 has an identical structure comprising a second poppet 66 that engages a second third seat in the check valve bore 53. The second poppet 66 has an aperture there through into which a second pin 68 of the pilot plunger 54 extends. A second sphere 70 is urged against a fourth seat in this second poppet's aperture by a piston 72 that is biased by a second spring 74. In the neutral position of the pilot plunger 54 as illustrated in FIG. 2, the respective plunger pins 58 and 68 do not apply force to either check valve sphere 61 or 70.

FIG. 2 illustrates the valve assembly 18 in the "neutral" position in which both control valves are biased by their springs to connect the respective intermediate passages 34 and 35 to the tank return line 24. However, the pilot operated check valves 36 and 40 prevent flow of fluid from the hydraulic cylinder 20 to the intermediate passages, because both of those passages are substantially at tank pressure and the check valves are not pilot operated at this time. In the neutral position, pressure in the load sense passage 46 bleeds past the pilot plunger 54 to both intermediate passages 34 and 35 and on into the tank return passage 24.

To operate the actuator 20, one of the two solenoid valves 28 or 30 within the assembly 18 will be energized depending upon the desired direction of movement of the piston 26. For example, the first solenoid actuated valve 28 is energized to extend the piston's rod from the cylinder 20. Doing so connects the pump supply line 16 to the first intermediate passage 34 thereby applying pressurized fluid to a nose chamber 84 of the first pilot operated check valve 36. Pressure from that fluid forces the first pilot operated check valve 36 to open in the free-flow direction and allows the fluid to flow to the first workport 38 and the first cylinder chamber 21.

The pressure in the nose chamber 84 also shifts the pilot plunger 54 to the right, toward the second pilot operated check valve 40. This motion forces the second plunger pin 68 against the second sphere 70 of the second pilot operated check valve 40, thereby unseating that sphere. When the second sphere 70 is unseated, pressure within a rear chamber 86 of the second pilot operated check valve 40 is vented to tank which reduces the pressure within that chamber. A small transverse aperture 80 provides a path through the second check valve poppet 66 from the second workport 40 into a cavity between that poppet 66 and piston 71, thereby applying the workport pressure to an annular surface on the piston. This causes the second check valve piston 71 to move away from engagement with the second sphere 70 so that the force from the plunger pin 68 also unseats the second check valve poppet 66. This action opens a path into the second intermediate passage 35 through which fluid from the second workport 42 drains to the second control valve 30 and onward into the tank passage 24.

As the second pilot operated check valve 35 opens fully, the pilot plunger 54 moves farther toward it (rightward in the drawing) and into a position where pressure from the first intermediate passage 34 is communicated through the plunger's longitudinal grooves and notch 59 into the load sense passage 46. Thus, the pressure in the first workport 38 is applied to the load sense passage 46. At the same time, the position of the plunger 54 is such that the land 76 engages the wall of the check valve bore 53 and blocks pressure in the second intermediate passage 35 from reaching the load sense passage 46.

In order to move the cylinder piston 26 in the opposite direction within the cylinder 20, pressurized hydraulic fluid must be applied to the second cylinder chamber 22 through the second workport 42. To accomplish this, the second control valve 30 is activated to couple the pump supply line 16 to the second intermediate passage 35 while the first control valve 28 is de-energized. This action reverses the operation described previously with respect to activating the first control valve 28. That is, pressure within the second intermediate passage 35 drives the pilot plunger 54 toward the first pilot operated check valve 36 (leftward in the drawings) which opens that check valve. This motion of the pilot plunger 54 also opens a path between the second intermediate passage 35 and the load sense passage 46 and blocks communication between the first intermediate passage 34 and the load sense passage. This generates a load sense signal from the pressure at the second intermediate passage 34.

The foregoing description was primarily directed to a preferred embodiment of the invention. Although some attention was given to various alternatives within the scope of the invention, it is anticipated that one skilled in the art will likely realize additional alternatives that are now apparent from disclosure of embodiments of the invention. Accordingly, the scope of the invention should be determined from the following claims and not limited by the above disclosure.

What is claimed is:

1. A control valve assembly for a hydraulic system having a pump supply line, a tank return line and a double acting actuator, the control valve assembly comprising:

a first workport and a second workport for connection to the double acting actuator;

a two-position, three-way first control valve connected to the pump supply line and the tank return line and including a first common port, the first control valve having a first position in which the pump supply line is connected to the first common port and a second position in which the tank return line is connected to the first common port;

a two-position, three-way second control valve connected to the pump supply line and the tank return line and including a second common port, the second control valve having a first position in which the pump supply line is connected to the second common port and a second position in which the tank return line is connected to the second common port;

a first pilot operated check valve having a fluid path connected between the first common port and the first workport with a free flow direction from the first common port to the first workport, and having a first pilot inlet connected to the second common port;

a second pilot operated check valve having a fluid path connected between the second common port and the second workport with a free flow direction from the second common port to the second workport, and having a second pilot inlet connected to the first common port; and a pilot valve plunger having a first state which opens the first pilot operated check valve when pressure in the second intermediate passage is greater than pressure in the first intermediate passage and having a second state which opens the second pilot operated check valve when pressure in the first intermediate passage is greater than pressure in the second intermediate passage, the pilot valve plunger also producing load sense signal that indicates which of a pressure at the first intermediate passage and a pressure at the second intermediate passage is greater.

2. The control valve assembly as recited in claim 1 further comprising a load sense passage in which the load sense signal is produced.

3. The control valve assembly as recited in claim 2 wherein the pilot valve plunger applies the greater pressure at the first common port and the second common port to the load sense passage.

4. The control valve assembly as recited in claim 2 wherein the pilot valve plunger in the first state provides a fluid path between the second intermediate passage and the load sense passage, and in the second state provides a fluid path between the first intermediate passage and the load sense passage.

5. The control valve assembly as recited in claim 1 wherein each of the first pilot operated check valve and the second pilot operated check valve comprises:

a poppet having an aperture with a seat;

a valve element within the aperture of the poppet to engage the seat;

a piston received within the aperture; and a spring biasing the piston into engagement with the valve element thereby urging the valve element against the seat.

6. The control valve assembly as recited in claim 5 wherein the valve element is a sphere.

7. The control valve assembly as recited in claim 1 wherein each of the first control valve and the second control valve comprises a solenoid which operates a valve element to control flow of fluid through the respective control valve.

8. A control valve assembly for a hydraulic system comprising:

a body having a pump supply passage, a tank return passage, a first intermediate passage, a second intermediate passage, a first workport, a second workport, and a bore which communicates with the first intermediate passage, the second intermediate passage, the first workport, and the second workport;

a first control valve mounted in the body, and having a first position which connects the pump supply line to the first intermediate passage and a second position which connects the tank return line to the first intermediate passage;

a second control valve mounted in the body, and having a first position which connects the pump supply line to the second intermediate passage and a second position which connects the tank return line to the second intermediate passage;

a first pilot operated check valve in the bore of the body and having a first check valve element which is biased into engagement with a first seat in the bore to close communication through the bore between the first intermediate passage and the first workport;

a second pilot operated check valve in the bore of the body and having a second check valve element which is biased into engagement with a second seat in the bore to close communication through the bore between the second intermediate passage and the second workport;

a pilot valve plunger received in the bore of the body and slidable therein in response to pressure in the first intermediate passage and pressure in the second intermediate passage, the pilot valve plunger having a first position which causes the first check valve element to move away from the first seat and a second position which causes the second check valve element to move away from the second seat; and a load sense circuit which, in response to movement of the pilot valve plunger, produces a load sense signal indicating which of a pressure at the first intermediate passage and a pressure at the second intermediate passage is greater.

9. The control valve assembly as recited in claim 8 wherein load sense circuit comprises a load sense passage, a first passage formed by the pilot valve plunger and in the first position providing a fluid path between the second intermediate passage and the load sense passage, and a second passage formed by the pilot valve plunger and in the second position providing a fluid path between the first intermediate passage and the load sense passage.

10. The control valve assembly as recited in claim 8 wherein the load sense circuit comprises a load sense passage; and the pilot valve plunger includes a load sense valve which in the first position of the pilot valve plunger conveys pressure from the second intermediate passage to the load sense passage, and in the second position of the pilot valve plunger conveys pressure from the first intermediate passage to the load sense passage.

11. The control valve assembly as recited in claim 10 wherein load sense valve connects the load sense passage to both the first intermediate passage and second intermediate passage in a state of the control valve assembly in which neither the first workport not the second workport is connected to the supply line.

12. The control valve assembly as recited in claim 8 wherein each of the first control valve and the second control valve comprises a solenoid which operates a valve element to control flow of fluid through the respective control valve.

13. A control valve assembly for a hydraulic system comprising:

a body having a pump supply passage, a tank return passage, a first intermediate passage, a second intermediate passage, a first workport, a second workport, and a bore which communicates with the first intermediate passage, the second intermediate passage, the first workport, and the second workport;

a first control valve mounted in the body, and having a first position which connects the pump supply line to the first intermediate passage and a second position which connects the tank return line to the first intermediate passage;

a second control valve mounted in the body, and having a first position which connects the pump supply line to the second intermediate passage and a second position which connects the tank return line to the second intermediate passage;

a first pilot operated check valve having a first poppet which engages a first seat in the bore to close communication through the bore between the first intermediate passage and the first workport, the first poppet has a first aperture with a second seat formed therein, a first sphere and a first piston within the first aperture with a first cavity there between, a first spring biasing the first piston against the first sphere which is then urged against the second seat, and the first poppet having a first transverse aperture providing a path between first workport and the first cavity;

a second pilot operated check valve having a second poppet which engages a third seat in the bore to close communication through the bore between the second intermediate passage and the second workport, the second poppet has a second aperture with a fourth seat formed therein, a second sphere and a second piston within the second aperture with a second cavity there between, a second spring biasing the second piston against the second sphere which is then urged against the fourth seat, and the second poppet having a second transverse aperture providing a path between second workport and the second cavity;

a pilot valve plunger received in the bore of the body and slidable therein in response to pressure in the first intermediate passage and pressure in the second intermediate passage, the pilot valve plunger having a first position which causes the first sphere to move away from the second seat and a second position which causes the second sphere to move away from the fourth seat; and a load sense circuit which, in response to movement of the pilot valve plunger, produces a load sense signal indicating which of a pressure at the first intermediate passage and a pressure at the second intermediate passage is greater.

14. The control valve assembly as recited in claim 13 wherein each of the first control valve and the second control valve comprises a solenoid which operates a valve element to control flow of fluid through the respective control valve.

15. The control valve assembly as recited in claim 13 wherein load sense circuit comprises a load sense passage, a first passage formed by the pilot valve plunger and in the first position providing a fluid path between the second intermediate passage and the load sense passage, and a second passage formed by the pilot valve plunger and in the second position providing a fluid path between the first intermediate passage and the load sense passage.

16. The control valve assembly as recited in claim 13 wherein the load sense circuit comprises a load sense passage opening into the bore in the body; and the pilot valve plunger includes a load sense valve element which in the first position of the pilot valve plunger conveys pressure from the second intermediate passage to the load sense passage, and in the second position of the pilot valve plunger conveys pressure from the first intermediate passage to the load sense passage.

17. The control valve assembly as recited in claim 16 wherein load sense valve element connects the load sense passage to both the first intermediate passage and second intermediate passage in a state of the control valve assembly in which neither the first workport not the second workport is connected to the supply line.

* * * * *